United States Patent [19]

Brightwell

[11] 4,366,391

[45] Dec. 28, 1982

[54] FUEL BURNER CONTROL SYSTEM CIRCUITS

[75] Inventor: Alan Brightwell, Stourbridge, England

[73] Assignee: British Gas Corporation, London, England

[21] Appl. No.: 237,766

[22] Filed: Feb. 24, 1981

[30] Foreign Application Priority Data

Nov. 6, 1980 [GB] United Kingdom ..... 8035734

[51] Int. Cl.[3] ..... H01H 35/00

[52] U.S. Cl. ..... 307/129

[58] Field of Search ..... 307/129; 361/182

[56] References Cited

U.S. PATENT DOCUMENTS 2,747,146 5/1956 McDonald ..... 307/129 X

*Primary Examiner*—Michael L. Gellner

*Attorney, Agent, or Firm*—Oblon, Fisher, Spivak, McClelland & Maier

[57] ABSTRACT

A fuel burner control system is disclosed which uses a frequency sensitive diode pump circuit fed by a series of input pulses having a repetition rate within a predetermined range. The diode pump circuit produces an output having a direct current component which exceeds a predetermined threshold when the repetition rate of the input pulses is within a predetermined range. A comparator circuit delivers a pulse signal to a fuel control device when the direct current component exceeds a predetermined threshold.

4 Claims, 3 Drawing Figures

FUEL BURNER CONTROL SYSTEM CIRCUITS

BACKGROUND OF THE INVENTION

1. Field of the Invention

This invention relates to control units for fuel burners and, in particular, to circuits for control units incorporating microprocessors. It finds application in microprocessor based burner control units which may be used alone to control a single burner or in combination with other similar control units and a supervisory circuit to operate more than one burner.

2. Description of the Prior Art

In our copending application No. 80/35733, United Kingdom, Nov. 6, 1980, there is described a fuel burner control system incorporating a safety device based on an inhibiting circuit which periodically connects and disconnects a power supply to a fuel burner control under the influence of a flame detector probe.

SUMMARY OF THE INVENTION

Accordingly, it is an object the present invention to extend the principle of pulsing signals described by utilizing a checking circuit which is sensitive to a prescribed frequency band. This ensures fail-safe operation in computerised control circuits should the clock frequency change by more than a predetermined amount.

According to the present invention there is provided a circuit for a fuel burner control system comprising a source of input pulses having a repetition rate which is normally within a predetermined range, frequency sensitive diode pump circuit means sensitive to said pulses to produce an output having a direct current component which exceeds a predetermined threshold when the repetition rate of said input pulses is within said predetermined range but not when the repetition rate is outside said range and a comparator circuit adapted to deliver a control signal to the fuel control means when the direct component exceeds the predetermined threshold.

BRIEF DESCRIPTION OF THE DRAWINGS

An embodiment of the invention will now be described by way of example with reference to the accompanying drawings in which.

DETAILED DESCRIPTION

Figure 1:
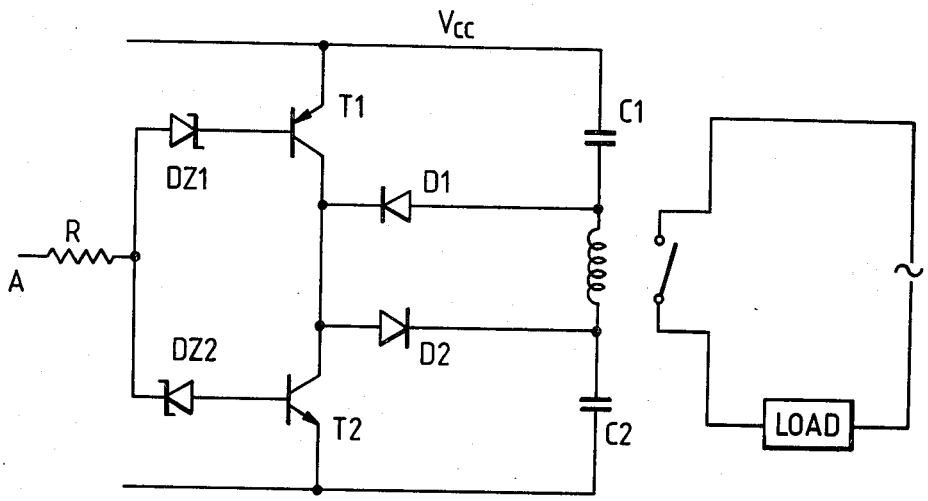
FIG. 1 shows a basic diode pump detector circuit

Referring now to FIG. 1 of the drawings, there is shown a diode pump circuit which, conveniently, may be fed with a stream of pulses at its input A. A limiter resistor R prevents excessive input current flow. The pump circuit comprises a pair of zener diodes DZ1,DZ2 feeding two complementary switching transistors T1,T2. The collectors of the switching transistors are coupled to two reservoir capacitors C1,C2 which are in series with the drive coil of a relay which controls the load, which may be a fuel supply valve. Coupling diodes D1,D2 direct the current flow to the reservoir capacitors according to which transistor is conducting.

Figure 2:
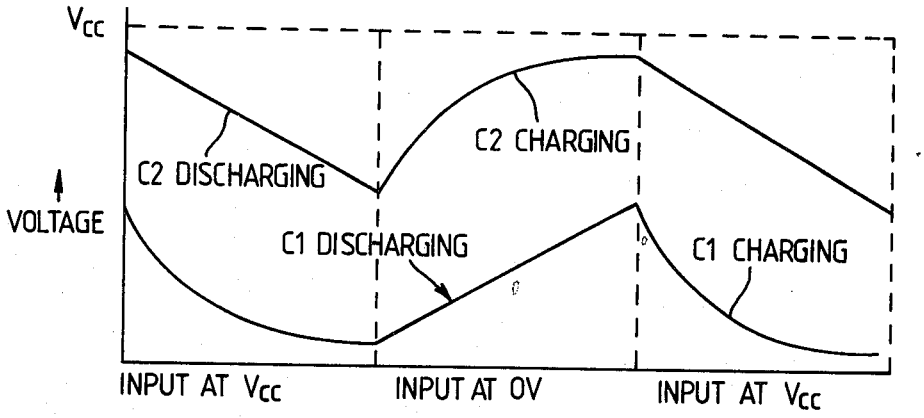
FIG. 2 shows how voltage levels at different parts of the circuit of FIG. 1 change with time.

The characteristics of the diode pump circuit are illustrated in FIG. 2 which shows the voltage across the two reservoir capacitors as the circuit input A is switched alternately high and low. The relay drive voltage, which is the difference between the two capacitor voltages remains substantially constant so long as the switching continues at a predetermined rate, but the relay will drop out if the switching becomes too slow.

Figure 3:
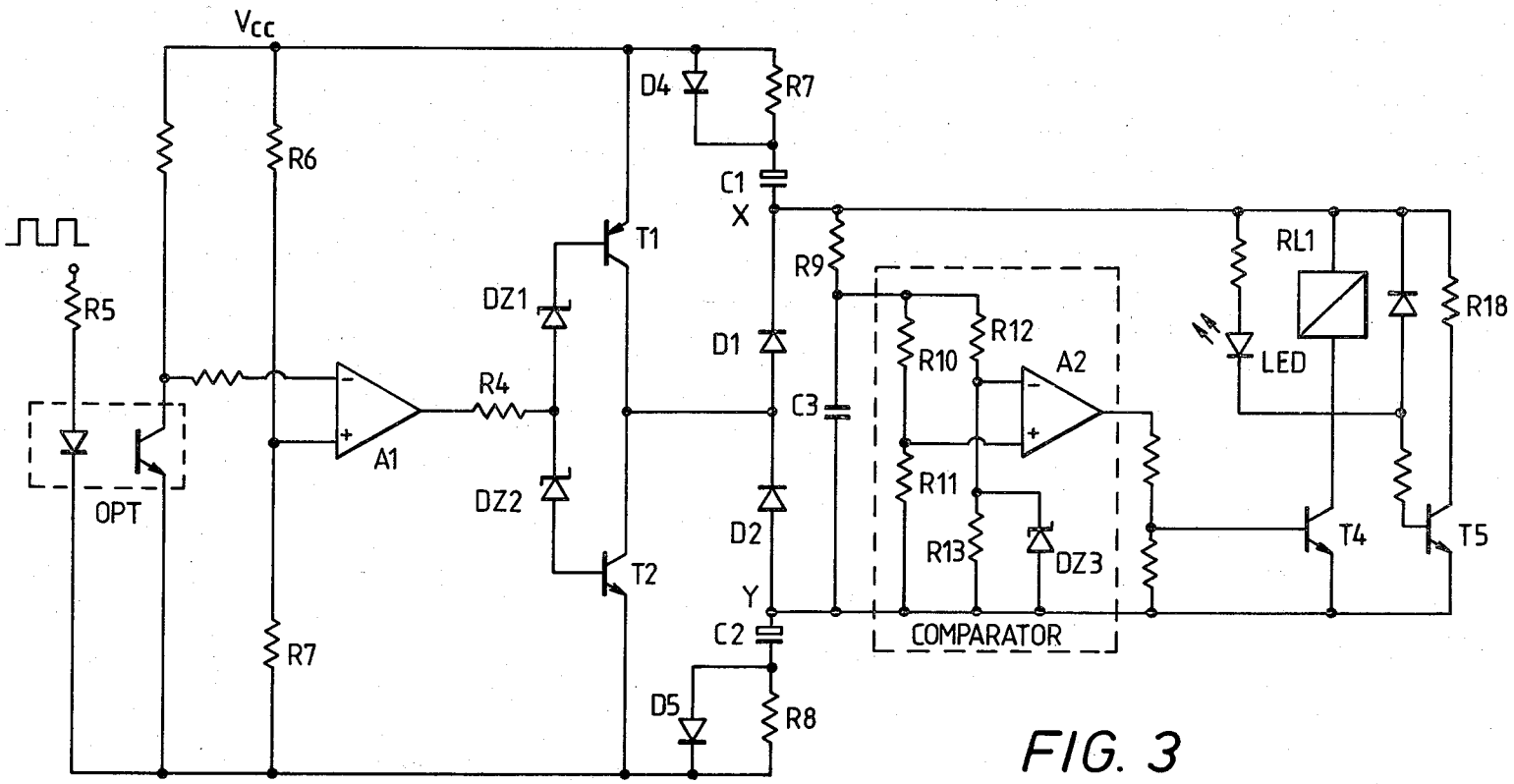
FIG. 3 shows a predetermined frequency bandpass circuit in accordance with a specific embodiment of the invention.

An embodiment suitable for microprocessor-based operation with a discrete pass band is shown in FIG. 3. Pulses from a microprocessor output circuit pass by way of a resistor R5 and an opto-electronic isolator OPT to one input of a comparator A1, the other input of which is connected to a potential divider R6, R7 across the DC supply. The pulses are fed by way of the input resistor R4 and sener diodes DZ1,DZ2 to a pair of complementary switching transistors T1, T2 dividing a diode pump circuit comprising diodes D1, D2, capacitors C1, C2 and the impedance of the circuit connected at points X and Y. The pump circuit is loaded by either resistor R18 or relay coil RL1, the impedance of the resistor R18 being set approximately equal to that of the coil to maintain the circuit loading with the coil de-energised. A voltage comparator circuit R10, R11, R12, R13, DZ3 A2 is connected across the pump diodes D1, D2 and senses the mean input voltage via the integrator R9, C3. As the input voltage to the comparator increases to a predetermined value, the voltage across one input is clamped by a zener diode DZ3. The voltage at the other, positive, input continues to rise until it is greater than that at the negative input. At this point the output voltage of the comparator rises and a relay driver transistor T4 coupled thereto conducts, energising the relay coil RL1 and turning off a further transistor T5 to prevent further conduction through R18 and thereby maintaining the same circuit loading. The state of the relay is indicated by a light emitting diode LED.

Since the comparator has virtually no hysteresis, the pulse frequency at which the diode pump circuit turns it on will be the same as the frequency at which it turns it off.

In order to obtain a pass band, an upper frequency cut-off point can be obtained by limiting the discharge time of the pump circuit capacitors C1, C2, by means of series-connected resistors R7, R8. Diodes D4, D5 are connected across these resistors. The capacitors C1, C2 charge by way of the diodes and discharge by way of the resistors. As the pulse frequency increases, the capacitors have less time to discharge, with the result that the valve control relay is de-energised. The resistors R7, R8 also serve as current limiters, permitting the circuit to operate with lower rates transistors than would otherwise be required to drive the pump circuit.

Whilst particular circuit arrangements have been described it will be appreciated that various modifications may be made without departing from the ambit of the invention. For example, it is not necessary that the fuel supply to the burner be controlled by a relay and the discrete components of the diode pump circuit may be replaced by an integrated circuit.

I claim:

1. A circuit for a fuel burner control system comprising a source of input pulses having a repetition rate which is normally within a predetermined range, frequency sensitive diode pump circuit means sensitive to said pulses to produce an output having a direct current component which exceeds a predetermined threshold when the repetition rate of said input pulses is within said predetermined range but not when the repetition rate is outside said range and comparator circuit means adapted to deliver a control signal to said fuel burner control system when said direct current component exceeds said predetermined threshold.

2. A circuit for a fuel burner control system comprising a source of input pulses having a repetition rate which is normally within a predetermined range, frequency sensitive diode pump circuit means insensitive to said pulses to produce an output having a direct current component which exceeds a predetermined threshold when the repetition rate of said input pulses is within said predetermined range but not when the repetition rate is outside said range and comparator circuit means adapted to deliver a control signal to said fuel burner control system when said direct current component exceeds said predetermined threshold, wherein said diode pump circuit includes a pair of capacitors which are successively charged and discharged by the application of pulses to said input, said circuit further including means for sensing the difference of the potentials to which the capacitors are charged.

3. A circuit as claimed in claim 2 wherein said comparator circuit means includes voltage clamping means across an input coupled to said diode pump circuit means.

4. A circuit as claimed in any one of claims 2 or 3 wherein resistors are connected in series with said capacitors.

* * * * *